US007852181B2

(12) United States Patent
Opolka

(10) Patent No.: US 7,852,181 B2
(45) Date of Patent: Dec. 14, 2010

(54) PACKAGE OR SUPPORT FOR AN ELECTRICAL DEVICE

(75) Inventor: Rainer Opolka, Solingen (DE)

(73) Assignee: Zweibruder Optoelectronics GmbH, Solingen (DE)

( * ) Notice: Subject to any disclaimer, the term of this patent is extended or adjusted under 35 U.S.C. 154(b) by 382 days.

(21) Appl. No.: 11/998,318

(22) Filed: Nov. 29, 2007

(65) Prior Publication Data

US 2008/0143464 A1 Jun. 19, 2008

(30) Foreign Application Priority Data

Dec. 6, 2006 (DE) ..... 10 2006 057 456

(51) Int. Cl.
*H01H 9/00* (2006.01)

(52) U.S. Cl. ..... 335/205; 335/207; 362/189; 362/200

(58) Field of Classification Search ..... 362/200, 362/189; 335/205–207
See application file for complete search history.

(56) References Cited

U.S. PATENT DOCUMENTS 3,162,376 A * 12/1964 Furuya ..... 362/158
3,448,419 A * 6/1969 Myatt ..... 335/206
3,713,056 A * 1/1973 Hosokawa ..... 335/206
3,790,912 A * 2/1974 Murphy ..... 335/205
4,760,504 A * 7/1988 Schaller et al. ..... 362/205
6,454,435 B1 * 9/2002 Altman ..... 362/200
6,802,621 B2 * 10/2004 Adeler ..... 362/157
7,465,060 B2 12/2008 Opolka
2007/0206385 A1 9/2007 Opolka

* cited by examiner

*Primary Examiner*—Anh T Mai
*Assistant Examiner*—Alexander Talpalatskiy
(74) *Attorney, Agent, or Firm*—Andrew Wilford

(57) ABSTRACT

An electrical device has a battery, a load, wiring connecting the battery to the load, and a switch in the wiring closable by a magnetic field to energize the load from the battery. It is enclosed in a package or support having an envelope surrounding the electrical device, a magnet shiftable on the envelope between an on position juxtaposed with and actuating the switch and an off position spaced from and not actuating the switch, and a spring urging the magnet into the off position.

9 Claims, 1 Drawing Sheet

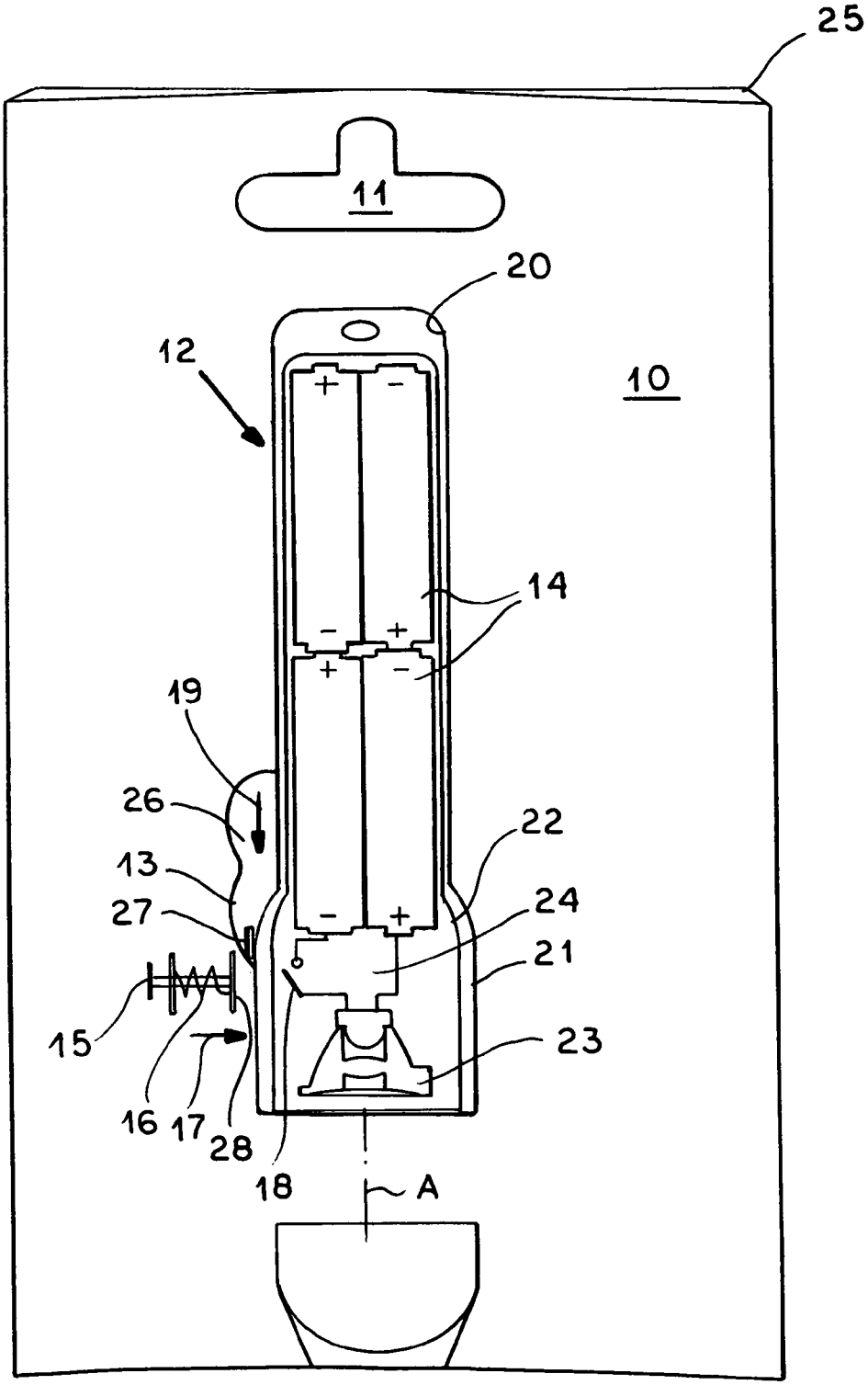
25
11
20
12
10
14
19
26
22
13
24
27
21
15
23
16
17
28
18
A

PACKAGE OR SUPPORT FOR AN ELECTRICAL DEVICE

FIELD OF THE INVENTION

The present invention relates to a package or support for an electrical device. More particularly this invention concerns a batter-powered electrical device such as a flashlight.

BACKGROUND OF THE INVENTION

Such a package or a holder has a pocket for the battery-powered device, e.g. flashlight, that in turn has an on-off switch. The package has an externally actuatable means for briefly turning on the device for testing purposes by closing the circuit of the device without opening the package. Such a system is described in US 2007/0206385.

Commercial goods are almost invariably sold in some sort of packaging. With electrical or electronic devices, there is a risk of damage that can be minimized by an appropriate package. It is also desirable to design the package so as to resist theft, and this requires that the packaged parts on the one hand cannot easily be removed from the package or the holder, and on the other hand that the size of the package thwart the unnoticed pocketing of the package and its contents. In addition, the package carry provide product information, advertising, a bar code, and other indicia on the outside of the package in enclosed inserts, cardboard, or the like.

A standard such package in the blister package that is made of an envelope formed by one or two plastic parts made of shaped plastic film and forming the device-holding pocket. When one of the films is transparent, the two parts can sandwich a sheet of cardboard with all this indicia, and having a hole aligned with the pocket and therefore surrounding the packaged item. Such a package is readily hung from a rack for display/storage/marketing purposes.

In packages of battery-powered lamps, in particular flashlights, the device can only be operated after it is unpackaged, which normally means after purchase. Thus a customer cannot be sure what he/she is buying is functional, or must arrange a laborious exchange or return. This is particularly a problem with low-end marketing where the sales people might not be familiar with inventory or have any discretion with regard to handling problems.

Thus in the above-described arrangement there is provided in the support or package an element that allows the device's switch to be temporarily actuated from outside without permanently affecting the packaging. Thus the device can be tested right at the display rack. The externally operable element actuating the device's switch can turn this switch on in such a manner that it will not stay on, so that as soon as the element is no longer actuated the device turns off. This makes it impossible to significantly discharge the device's battery by, for instance, reracking the device while it is turned on.

Other systems involve the use of an external switch in the form of a package-specific pushbutton or pressure element comprised of an elastic spring movable by external actuation along a path, but biased to move back to the off position when released. Here the pressure element acts on a pressure switch designed as a pushbutton that part of the device, and that is normally provided in addition to the standard on-off switch that holds in both the on and off positions. A final possible approach consists in using a pull or push element that is actuatable so as to move the pressure switch along the first slide-in path, a mechanically moved lever or similar means being used for this purpose.

OBJECTS OF THE INVENTION

It is therefore an object of the present invention to provide an improved package or support for an electrical device.

Another object is the provision of such an improved package or support for an electrical device that overcomes disadvantages of the above-described systems, in particular that allows function testing of an electrical device by means that is completely enclosed in the a package.

SUMMARY OF THE INVENTION

The instant invention is a package or support used in combination with an electrical device having a battery, a load, wiring connecting the battery to the load, and a switch in the wiring closable by a magnetic field to energize the load from the battery. The package or support has according to the invention an envelope surrounding the electrical device, a magnet shiftable on the envelope between an on position juxtaposed with and actuating the switch and an off position spaced from and not actuating the switch, and a spring urging the magnet into the off position.

Thus according to the invention the package has an externally actuatable means including a spring-loaded magnet body that is able to be moved from a rest position against the pressure of a spring into a position in which the proximity switch of the device is actuated to close the circuit of the device. This proximity switch is preferably a reed switch.

The reed switch in the form of a switching element is essentially known. It has two tongue-like contact springs that are composed of ferromagnetic material such that the approach of a magnet body results in a contacting of the contact tongues due to the magnetic field effect, thereby closing the circuit. An approach of the magnet is sufficient to generate such a contact closing; it is not necessary for the magnet to touch the reed switch or the housing of the electrical device. The reed switch or other proximity switch can be connected in parallel to or form part of the switching circuit that is used during normal operation of the device to switch the device on and off. In the last-mentioned case, the switch is a magnetic switch.

A spring-loaded permanent magnet in the form of a short cylindrical body can be used that can be moved against the force of a spring onto the electrical device until the reed switch closes. However, it can also be a ferromagnetic foil that in the rest position is located at a spacing from the electrical device and in response to the pressure of the thumb against the spring force or an elastic rubber piece is moved toward the reed switch. In each case a magnetic force must be sufficiently strong so as to effect a switching of the reed switch.

The particular advantage of this package consists in the fact that function testing of the electrical device can take place in a quasi contract-free manner, i.e. without contacting the device's standard on-off switch. Due to the spring, this system prevents an unauthorized permanent switching on of the electrical device from happening.

BRIEF DESCRIPTION OF THE DRAWING

The above and other objects, features, and advantages will become more readily apparent from the following description, reference being made to the accompanying drawing whose sole FIGURE is a partly diagrammatic front elevational view of the package/support according to the invention.

SPECIFIC DESCRIPTION

As seen in the drawing, a cardboard card 10 is formed with a hanging hole 11 and encased between a pair of shaped foils 25 forming an envelope of a bubble package. A flashlight 12 is fitted to a hole 20 formed in the card 10 in mating blisters 21 of the foils 25 that closely surround the flashlight 12.

This flashlight 10 has a housing 22 (shown in section) holding batteries 14, a lamp 23 and wiring 24 connecting the batteries 14 to the lamp 23. A switch 13 in this wiring 24 has stable open and closed positions for turning on and off the lamp 23, the lamp possessing an on-off switch 13 by which an internal electrical circuit can be opened and closed. This switch includes a normally open reed switch in series with the lamp 23. Such a reed switch typically has a pair of copper-clad ferromagnetic contacts at least one of elastically deformable when exposed to a magnetic field from a normal rest position out of contact with the other contact into an actuated position engaging it.

The switch 13 itself has a slide 26 movable in a direction 19 parallel to a longitudinal axis A of the flash light to shift a small permanent magnet 27 into alignment with the internal switch 18, thereby closing it and lighting the lamp 23. The considerable advantage of this type of actuation is that the housing 22 can be made water-tight of plastic, with no hole for the switch. The foils 25 so closely surround the slide 26 that it cannot be moved until the flashlight 12 has been taken out of the package.

According to the invention, a small pushbutton 15 provided on the card 10 carries or is formed with a permanent magnet 28 and can be moved against the force of a spring 16 in the direction of arrow 17 transverse to the direction 19 adjacent the reed switch 18. As a result of this movement, the field of this magnet 15 can close the switch 18 when the button 15 is pushed in against the spring 16.

Once the lamp has been purchased the pushbutton 15, spring 16, and magnet 28, which are of inconsequential cost, are discarded with the packaging and the on-off switch 13 is used. Since, as mentioned above blisters 21 are formed such that the on-off switch cannot be actuated until the flashlight 12 is taken out of them, the on-off switch 13 is functional with the unpackaged flashlight.

Obviously, a normally open pushbutton switch can be also used in place of magnetic switch 13, in which case the reed switch is wired in parallel to the pushbutton switch so the lamp can be switched on by the proximity switch 16 or by the disposable pushbutton switch.

I claim:

1. In combination with an electrical device having
a housing,
a battery in the housing,
a load in the housing,
wiring in the housing connecting the battery to the load,
a switch in the wiring closable by a magnetic field to energize the load from the battery, and
a first magnet shiftable on the housing between an on position juxtaposed with and actuating the switch and an off position spaced from and not actuating the switch, a package or support comprising:
a packaging envelope separable from the housing and completely enclosing the electrical device;
a second magnet shiftable on the envelope between an on position juxtaposed through the envelope with and actuating the switch and an off position spaced from and not actuating the switch;
a spring on the envelope urging the second magnet into the off position.

2. The combination defined in claim 1 wherein the switch is a reed switch.

3. The combination defined in claim 1 wherein the second magnet is formed as part of a foil.

4. The combination defined in claim 1 wherein the second magnet and spring are mounted on the envelope wholly outside the housing.

5. The combination defined in claim 4 wherein the housing is a magnetically permeable dielectric.

6. The combination defined in claim 4 wherein the load is a light bulb.

7. The combination defined in claim 1 wherein the first magnet is shiftable in a direction generally perpendicular to a direction in which the second magnet is shiftable.

8. The combination defined in claim 7 wherein the device is an elongated flashlight, the first magnet being shiftable generally parallel to a longitudinal axis of the flashlight and the second magnet transverse thereto.

9. The combination defined in claim 1 wherein the envelope is shaped to inhibit shifting of the first magnet between its on and off positions.

* * * * *